United States Patent [19]

Schrimpf et al.

[11] 4,093,403

[45] June 6, 1978

[54] MULTISTAGE FLUID-ACTUATED DIAPHRAGM PUMP WITH AMPLIFIED SUCTION CAPABILITY

[75] Inventors: Carl F. Schrimpf, Wauwatosa; Russel J. Van Rens, Waukesha, both of Wis.

[73] Assignee: Outboard Marine Corporation, Waukegan, Ill.

[21] Appl. No.: 723,334

[22] Filed: Sep. 15, 1976

[51] Int. Cl.[2] ..... F04B 3/00; F04B 43/06

[52] U.S. Cl. ..... 417/246; 417/395; 123/139 AH; 123/139 AN

[58] Field of Search ..... 417/395, 389, 384, 246, 417/256, 257, 265; 123/139 AH, 139 AN; 92/13.2, 13.3; 261/DIG. 68

[56] References Cited

U.S. PATENT DOCUMENTS

| | | | |
|---|---|---|---|
| 2,585,172 | 2/1952 | Reynolds | 417/395 |
| 2,713,854 | 7/1955 | Conover | 123/139 AH |
| 2,713,858 | 7/1955 | Armstrong et al. | 417/395 |
| 2,835,239 | 5/1958 | Dickrell | 123/139 AH |
| 2,997,961 | 8/1961 | McDuffie | 417/246 |
| 3,263,701 | 8/1966 | Johnson | 261/DIG. 68 |
| 3,586,461 | 6/1971 | Erlandson | 417/246 |

FOREIGN PATENT DOCUMENTS

| | | | |
|---|---|---|---|
| 713,099 | 10/1931 | France | 417/265 |

*Primary Examiner*—Carlton R. Croyle

*Assistant Examiner*—Thomas I. Ross

*Attorney, Agent, or Firm*—Michael, Best & Friedrich

[57] ABSTRACT

Disclosed herein is a fluid-actuated, diaphragm pump which is particularly adaptable for use as a fuel pump for a multi-cylinder, two-cycle internal combustion engine and which includes an inlet chamber, an outlet chamber, a first diaphragm separating the inlet chamber into a first pulse chamber and a suction chamber, and a second diaphragm separating the outlet chamber into a second pulse chamber and a pressure chamber. The two pulse chambers are connected to separate sources of regularly cycling or pulsating pressures which are at least 90° out of phase from each other and the two diaphragms are oscillated sequentially, in response to the pressure variations in the respective pulse chambers, between a suction position and a pumping position whereby fluid is first drawn into the suction chamber through an inlet, subsequently pumped therefrom into the pressure chamber, and then pumped from the pressure chamber through an outlet. Each of the diaphragms is biased towards a suction position by a spring disposed in the respective suction and pressure chambers. The biasing force of the spring in the suction chamber is substantially greater than that of the spring in the pressure chamber so as to boost the suction capability of the pump without hindering the outlet pressure capacity.

14 Claims, 2 Drawing Figures

Fig. 1
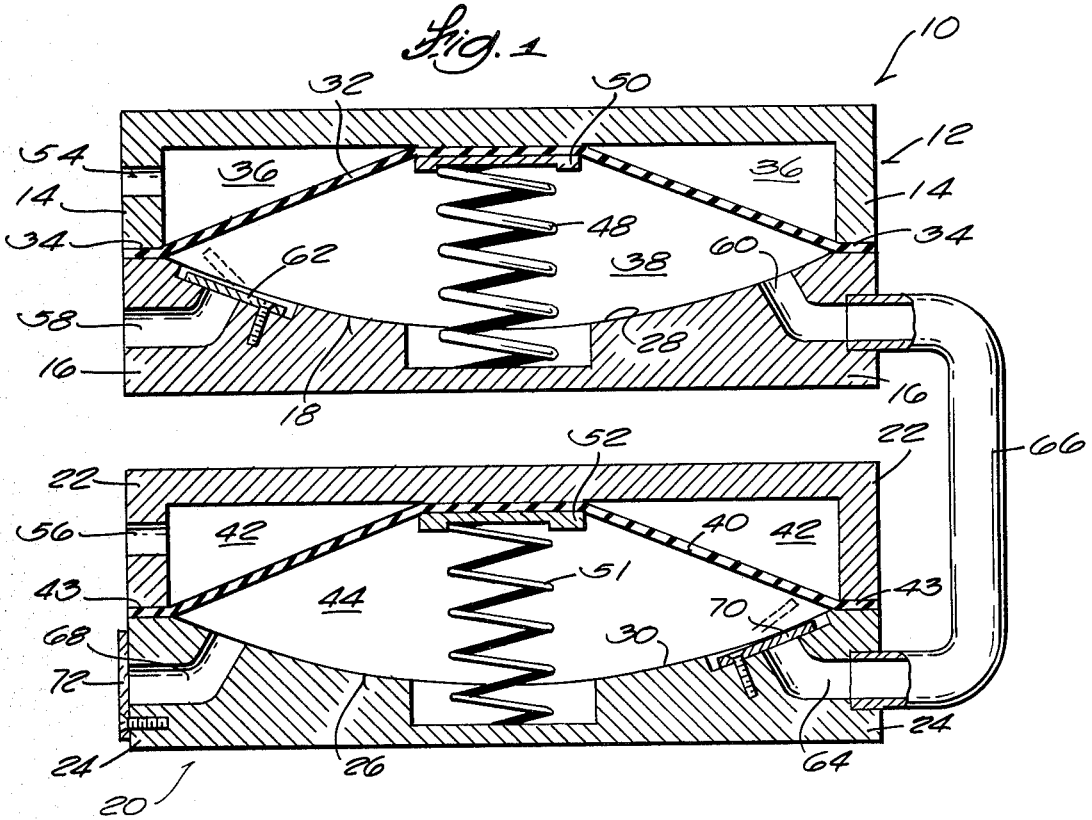
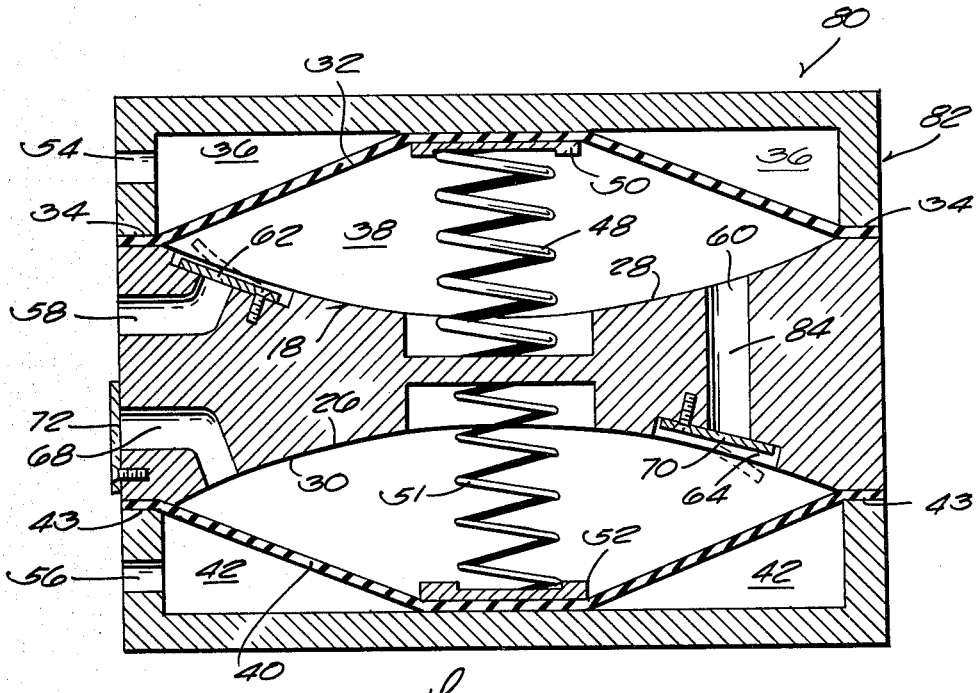
Fig. 2

MULTISTAGE FLUID-ACTUATED DIAPHRAGM PUMP WITH AMPLIFIED SUCTION CAPABILITY

BACKGROUND OF THE INVENTION

This invention relates to pumps and, more particularly, to fluid actuated, diaphragm pumps.

Fluid actuated, diaphragm pumps have many applications. One application is as a fuel pump for a two-cycle internal combustion engine, such as an outboard motor. The pulse chamber of the pump is connected to the engine crankcase wherein the pressure varies cyclically in response to the reciprocative movement of the engine piston. Fluid actuated, diaphragm pumps including two or more separate diaphragms and pumping chambers connected in series and actuated by separate sources of pressure which are oscillating out of phase from each other are known. The Armstrong et al U.S. Pat. No. 2,713,858, issued July 26, 1955, discloses a diaphragm pump of this type.

SUMMARY OF THE INVENTION

The invention provides a fluid actuated pump including separate inlet and outlet chambers each having respective first and second wall portions, a first flexible diaphragm separating the inlet chamber into a first pulse chamber and a suction chamber including the first wall portion, a first biasing means for biasing the first diaphragm away from the first wall portion, an intake through which a fluid to be pumped is admitted into the suction chamber, a second flexible diaphragm separating the outlet chamber into a second pulse chamber and a pressure chamber including the second wall portion, a second biasing means for biasing the second diaphragm away from the second wall portion, fluid transfer means extending between the suction and pressure chambers and through which the fluid is transferred from the suction chamber to the pressure chamber when the first diaphragm is moved towards the associated wall portion, and a fluid outlet through which the fluid is pumped from the pressure chamber when the second diaphragm is moved towards the associated wall portion. The first pulse chamber is connected in communication with a first source of regularly cycling pressure pulses and the second pulse chamber is connected in communication with a second source of regularly cycling pressure pulses which are at least 90° out of phase from the first pressure pulses. The first diaphragm in response to the cyclical pressure variations in the first pulse chamber alternately moves away from the associated wall portion to draw the fluid into the suction chamber through the fluid intake and toward the associated wall portion to pump the fluid from the suction chamber into the pressure chamber through the fluid transfer means. The second diaphragm in response to the cyclical pressure variations in the second pulse chamber alternately moves away from the associated wall portions to admit fuel being pumped from the fluid transfer means by the first diaphragm into the pressure chamber and toward the associated wall portion to pump the fluid from the pressure chamber through the fluid outlet.

In one embodiment, the diaphragm biasing means comprises a compression spring disposed between each diaphragm and the associated wall portion which springs are of different strengths. The biasing force of the spring associated with the first diaphragm approaches but is less than the pressure force provided by the pressure in the first pulse chamber and acting on the first diaphragm to move it in a direction towards the associated wall portion and the biasing force of the spring associated with the second diaphragm is substantially less than the pressure force provided by the pressure in the second pulse chamber and acting on the second diaphragm to move it toward the associated wall portion.

In another embodiment, separate housings are provided for defining the inlet and outlet chambers and the suction chamber and the pressure chamber are connected in communication by a conduit means.

In a further embodiment, the inlet and outlet chambers are defined by an integral housing and the suction and pressure chambers are connected in communication by an internal passage in the housing.

One of the principal features of the invention is the provision of a fluid actuated diaphragm pump having a simplified construction.

Another of the principal features of the invention is the provision of a fluid actuated diaphragm pump including means for increasing the suction capability without hindering the output pressure capacity.

Still another of the principal features of the invention is the provision of a fluid actuated pump which includes a pair of diaphragm pumping chambers connected in series and is particularly adaptable for use as a fuel pump for a multi-cylinder, two-cycle internal combustion engine.

Other features and advantages of the invention will become apparent upon reviewing the following detailed description, the drawing and the appended claims.

BRIEF DESCRIPTION OF THE DRAWING

FIG. 1 is a sectioned, side elevational view of a fluid actuated fuel pump embodying various of the features of the invention.

FIG. 2 is a sectioned, side elevational view of another embodiment of a fluid actuated fuel pump embodying various of the features of the invention.

Before explaining preferred embodiments of the invention in detail, it is to be understood that the invention is not limited in its application of the details of construction and the arrangements of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Illustrated in FIG. 1 is a fluid actuated, diaphragm pump 10 which is particularly adaptable for use as a fuel pump for an internal combustion engine, such as a multi-cylinder, two cycle outboard motor, and will be described for this use. The fuel pump 10 has a first housing 12 including parts 14 and 16 which cooperate to define an inlet chamber 18 and a separate second housing 20 including parts 22 and 24 which cooperate to define an outlet chamber 26. The interior wall of each of the housing parts 16 and 20 includes respective wall portions 28 and 30 having the shape of a segment of a sphere, i.e., the wall portions 28 and 30 have a concave, spherical shape.

Disposed in the inlet chamber 14 is a first flexible diaphragm 32 which extends completely across the inlet chamber 18 with the outer peripheral portion 34 thereof suitably clamped between the housing parts 14 and 16 to separate the inlet chamber into a first pressure or pulse chamber 36 and a first pumping chamber or suction chamber 38 including the spherical wall portion 28. Disposed in the outlet chamber 26 is a second flexible diaphragm 40 which extends completely across the outlet chamber 26 with the outer peripheral portion 43 thereof suitably clamped between housing parts 22 and 24 to separate the outlet chamber into a second pressure or pulse chamber 42 and a second pumping chamber or pressure chamber 44 including the spherical wall portion 30.

While various suitable diaphragm arrangements can be used, the diaphragms 32 and 40 preferably are generally cup-shaped and are made from a suitable resilient material such as neopreme rubber. If desired, the diaphragms 32 and 40 can have the same dimensions.

For reasons to be explained hereinafter, means is provided for biasing the diaphragms 32 and 40 toward an expanded condition illustrated in FIG. 1 where the central portions thereof are spaced from the respective spherical wall portions 28 and 30. Provided for this purpose is a first helical, compression spring 48 which is disposed in the suction chamber 38 with one end bearing against the spherical wall portion 28 and the other end bearing against a pad 50 carried on the central interior portion of the first diaphragm 32 and a second helical, compression spring 51 which is disposed in the pressure chamber 44 with one end bearing against the spherical wall portion 30 and the other end bearing against a pad 52 carried on the central interior portion of the second diaphragm 40.

The diaphragms 32 and 40 are oscillated alternately, in response to cyclical pressure variations present in the respective pulse chambers 36 and 42, away from the respective wall portions 28 and 30 to an expanded condition, hereinafter referred to as a suction position, and toward the respective wall portions 28 and 30 to a substantially collapsed condition generally adjacent thereto (not shown), hereinafter referred to as a pumping position.

Located in the first housing part 14 is a first pressure inlet 54 which communicates with the first pulse chamber 36 and is connected in communication with a first source of regularly cycling pressure pulses, such as a portion of the crankcase of a multi-cylinder, two-cycle internal combustion engine (not shown) wherein the pressure varies in response to the reciprocative movement of the associated engine piston. Located in the second housing part 22 is a second pressure inlet port 56 which communicates with the second pulse chamber 42 and is connected in communication with a second source of regularly cycling pressure pulses which are 90° and up to 270°, and optimally 180°, out of phase from the first pressure pulses. For example, the second pressure inlet 56 can be connected in communication with another portion of the engine crankcase where the piston reciprocating therein is at least 90° out of phase from the piston reciprocating in the portion of the engine crankcase to which the first pressure port 54 is connected.

During the expansion or suction stroke of the first diaphragm 32, in response to decreasing pressure in the first pulse chamber 36, fuel is admitted into the suction chamber 38 through a fuel intake 58 located in the first housing part 16 and communicating with the suction chamber 38. During the collapsing or the pumping stroke of the first diaphragm 32, in response to increasing positive pressure in the first pulse chamber 36, fuel is pumped from the suction chamber through a fuel transfer inlet 60 located in the first housing part 16 generally opposite to the fuel intake 58. Back flow of fuel through the fuel intake 58 during the pumping stroke of the first diaphragm 32 is prevented by a suitable check valve 62 disposed inside the suction chamber 58 and arranged to close the fuel intake 58 when in the closed position. The differential pressure between the fuel in the supply system and the reduced pressure created in the suction chamber 38 during the suction stroke of the first diaphragm 52 is sufficient to open the check valve 62 and to permit fuel to be drawn into the suction chamber 38 through the fuel intake 58.

Fuel pumped from the suction chamber 38 during the pumping stroke of the first diaphragm 32 is admitted into the pressure chamber 44 through a fuel transfer outlet 64 which is located in the second housing part 24, which communicates with the pressure chamber 44, and which is connected in communication with the fuel transfer inlet 60 by a suitable conduit means, such as a flexible hose 66 (shown diagrammatically).

During the collapsing or pumping stroke of the second diaphragm 40, in response to increasing pressure in the second pulse chamber 42, fuel is pumped from the pressure chamber 44 through a fuel outlet 68 located in the second housing part 24 generally opposite to the fuel transfer outlet 64. The fuel outlet 68 is connected in communication with the engine carburetor (not shown). Backflow of fuel through the fuel transfer outlet 68 during the pumping stroke of the second diaphragm 40 is prevented by a suitable check valve 70 disposed inside the pressure chamber 44.

Since the cyclical pressure pulses in the second pulse chamber 42 are at least 90° out of phase from those in the first pulse chamber 36 as mentioned above, the pressure in the second pulse chamber 42 is either substantially zero or negative during the time the pressure in the first pulse chamber 36 is increasing positively, and vice versa. Thus, the second diaphragm 40 is either moving towards an expanded condition or is in an expanded condition while the first diaphragm 32 is undergoing a pumping stroke and the first diaphragm 32 is either moving towards an expanded condition or is in an expanded condition while the second diaphragm 40 is undergoing a pumping stroke. The differential pressure between the suction chamber 38 and the pressure chamber 44 during the pumping stroke of the first diaphragm 32 is sufficient to open the check valve 70 and permit fuel flow into the pressure chamber 44.

Disposed in the fuel outlet 68 is a suitable check valve 72 for preventing flow through the fuel outlet 68 into the pressure chamber 44 when a reduced pressure exists therein and for permitting flow from the pressure chamber 44 through the fuel outlet 68 during the pumping stroke of the second diaphragm 40.

The negative pressure produced in the crankcase of a two-cycle engine normally is substantially less than the positive pressure. Consequently, the pressure force tending to expand the diaphragms 32 and 40 is substantially less than the pressure force tending to collapse them.

In order to boost the suction capability of the fuel pump 10 without hindering the output pressure capacity, the first spring 48 has a substantially higher strength than the second spring 51. That is, the first spring 48 is provided with a biasing force which approaches the positive pressure force provided by the pressure in the first pulse chamber 36 and acting on the first diaphragm 32 to move it toward a collapse position. The biasing force of the first spring 48 is sufficiently less than the pressure force so that the first diaphragm 32 can be moved to a substantially fully collapsed position in response to the increasing positive pressure in the first pulse chamber 36. As the first spring 48 is compressed, it stores energy for rapidly returning the first diaphragm 32 to an expanded condition when the pressure in the first pulse chamber 36 subsequently decreases to a negative level, thereby creating a high suction in the suction chamber 38.

The second spring 51 is provided with a biasing force which is substantially less than the positive pressure force provided by the pressure in the second pulse chamber 42 and acting on the second diaphragm 40 to move it towards a collapsed condition. The primary function of the second springs 51 is to provide a sufficient biasing force to insure that the second diaphragm 40 is returned to an expanded position rapidly enough so that the pressure chamber 44 can be filled by the fuel being pumped from the suction chamber 38 with a minimum resistance to flow. Thus, the second spring 51 offers little resistance to the positive pressure force acting on the second diaphragm 40, which means that most of this force is available for moving the second diaphragm 40 towards a collapsed position, thereby maximizing the pumping action provided by the second diaphragm 40 and the pressure of the fuel being delivered through the fuel outlet 68.

With this arrangement, the fuel pump 10, when connected to different portions of the crankcase of a multicylinder engine, can be arranged to be capable of drawing a vacuum having a negative value approaching the maximum positive crankcase pressure and to deliver fuel at a pressure approaching the maximum positive crankcase pressure.

FIG. 2 illustrates another embodiment of the invention including various components which are constructed and arranged in a manner similar to the embodiment illustrated in FIG. 1. Thus, the same reference numerals have been assigned to common components.

The basic differences between the fuel pump 80 shown in FIG. 2 and the fuel pump 10 shown in FIG. 1 is that the inlet chamber 18 and the outlet chamber 26 are defined by an integral housing 82 instead of separate housings and the inlet and outlet chambers are arranged so that the suction chamber 38 and the pressure chamber 44 are next to each other. Also, the housing 82 is provided with an internal passage 84 which extends between the fuel transfer inlet 60 and the fuel transfer outlet 64 and serves the same function as the conduit 66 in FIG. 1. Otherwise, the fuel pump 80 is arranged in substantially the same manner and operates in the same general manner as the fuel pump 10 shown in FIG. 1.

Various of the features are set forth in the following claims:

What is claimed is:

1. A fluid actuated fuel pump comprising means defining separate inlet and outlet chambers each including respective first and second wall portions, a first flexible diaphragm disposed in said inlet chamber and separating said inlet chamber into a first pulse chamber and a suction chamber including said first wall portion, said first diaphragm being movable away from and toward first wall portion, a fuel intake through which fuel is admitted into said suction chamber, a second flexible diaphragm in said outlet chamber and separating said outlet chamber into a second pulse chamber and a pressure chamber including said second wall portion, said second diaphragm being movable away from and toward said second wall portion, fuel transfer means communicating between said suction and pressure chambers and through which fuel is pumped from said suction chamber to said pressure chamber when said first diaphragm is moved toward said first wall portion, a fuel outlet through which fuel is pumped from said pressure chamber when said second diaphragm is moved toward said second wall portion, a first pressure inlet communicating with said first pulse chamber and adapted for connection to a first source of regularly cycling pressure pulses, a second pressure inlet communicating with said second pulse chamber and adapted for connection to a second source of regularly cycling pressure pulses, the second source of pressure pulses being of substantially equal intensity as the first source of pressure pulses and at least 90° out of phase from the first source of pressure pulses, whereby said first diaphragm in response to the cyclical pressure variations in said first pulse chamber alternately moves away from said first wall portion to draw fuel into said suction chamber through said fuel intake and toward said first wall portion to pump fuel from said suction chamber into said pressure chamber through said fuel transfer means and whereby said second diaphragm sequentially with respect to said first diaphragm and in response to cyclical pressure variations in said second pulse chamber alternatively moves away from said second wall portion to admit fuel being pumped through said fuel transfer means by said first diaphragm into said pressure chamber and toward said second wall portion to pump fuel from said pressure chamber through said fuel outlet, first biasing means for biasing said first diaphragm in a direction away from said first wall portion, and second biasing means for biasing said second diaphragm in a direction away from said second wall portion, the biasing force of said second biasing means being less than the biasing force of said first biasing means.

2. A fuel pump according to claim 1 including first check valve means for permitting fuel flow from said fuel intake to said suction chamber and for preventing fuel flow from said suction chamber to said fuel intake, second check valve means for permitting fuel flow from said fuel transfer means to said pressure chamber and for preventing fuel flow from said pressure chamber to said fuel transfer means, and third check valve means for permitting fuel flow from said pressure chamber to said fuel outlet and for preventing fuel flow from said fuel outlet to said pressure chamber.

3. A fuel pump according to claim 1 wherein said first and second diaphragms have a generally inverted cup shape and each are movable between a normally expanded position spaced from respective of said first and second wall portions and a substantially collapsed position generally adjacent respective of said first and second wall portions, and said first and second biasing means respectively bias said first and second diaphragms toward the expanded position.

4. A fuel pump according to claim 3 wherein each of said first and second biasing means is a compression spring.

5. A fuel pump according to claim 4 wherein said first and second wall portions have a generally concave, spherical shape.

6. A fuel pump according to claim 1 wherein each of said first and second biasing means is a compression spring disposed between respective of said first and second diaphragms and respective of said first and second wall portions, the force of said spring biasing said first diaphragm in a direction away from said first wall portion approaching but less than the pressure force provided by the pressure in said first pulse chamber and acting on said first diaphragm to move said first diaphragm in a direction toward said first wall portion, and the force of said spring biasing said second diaphragm in a direction away from said second wall portion being less than the biasing force of said spring biasing said first diaphragm and acting on said second diaphragm to move said second diaphragm away from said second wall portion.

7. A fuel pump according to claim 6 wherein said inlet and outlet chambers are respectively defined by separate first and second housings, and said fuel transfer means includes a fuel transfer inlet in said first housing communicating with said suction chamber, a fuel transfer outlet in said second housing communicating with said pressure chamber, and conduit means connecting said fuel transfer inlet in communication with said fuel transfer outlet.

8. A fuel pump according to claim 6 wherein said means defining said inlet and outlet chambers comprises an integral housing, and said fuel transfer means comprises an internal passage in said housing extending between said suction and pressure chambers.

9. A fluid actuated pump for pumping a fluid comprising means defining separate inlet and outlet chambers each including respective first and second wall portions, a first flexible diaphragm disposed in said inlet chamber and separating said inlet chamber into a first pulse chamber and a suction chamber including said first wall portion, said first diaphragm being movable away from and toward first wall portion, an intake through which the fluid to be pumped is admitted into said suction chamber, a second flexible diaphragm disposed in said outlet chamber and separating said outlet chamber into a second pulse chamber and a pressure chamber including said second wall portion, said second diaphragm being movable away from and toward said second wall portion, fluid transfer means communicating between said suction and pressure chamber and through which the fluid is pumped from said suction chamber to said pressure chamber when said first diaphragm is moved toward said first wall portion, an outlet through which the fluid is pumped from said pressure chamber when said second diaphragm is moved toward said second wall portion, a first pressure inlet communicating with said first pulse chamber and adapted for connection to a first source of regularly cycling pressure pulses, a second pressure inlet communicating with said second pulse chamber and adapted for connection to a second source or regularly cycling pressure pulses, the second source of pressure pulses being of substantially equal intensity as the first source of pressure pulses and at least 90° out of phase from the first source of pressure pulses whereby said first diaphragm, in response to the cyclical pressure variations in said first pulse chamber, alternatively moves away from said first wall portion to draw the fluid into said suction chamber through said intake and toward said first wall portion to pump the fluid from said suction chamber into said pressure chamber through said fluid transfer means and whereby said second diaphragm, sequentially with respect to said first diaphragm and in response to cyclical pressure variations in said second pulse chamber, alternately moves away from said second wall portion to admit the fluid being pumped through said fluid transfer means by said first diaphragm into said pressure chamber and toward said second wall portion to pump the fluid from said pressure chamber through said outlet, a first spring biasing said first diaphragm in a direction away from said first wall portion, the biasing force of said first spring approaching but being less than the pressure force provided by the pressure in said first pulse chamber and acting on said first diaphragm to move said first diaphragm in a direction toward said first wall portion, and a second spring biasing said second diaphragm in a direction away from said second wall portion, the biasing force of said second spring being less than the biasing force of said first spring and acting on said second diaphragm to move said second diaphragm away from said second wall portion.

10. A pump according to claim 9 wherein said first and second diaphragms have a generally inverted cup shape and each are movable between a normally expanded position spaced from respective of said first and second wall portions and a substantially collapsed position generally adjacent respective of said first and second wall portions, and said first and second springs respectively bias said first and second diaphragms toward the expanded position.

11. A pump according to claim 10 wherein each of said first and second springs is a compression spring.

12. A pump according to claim 11 wherein said first and second wall portions have a generally concave, spherical shape.

13. A pump according to claim 9 wherein said inlet and outlet chambers are respectively defined by separate first and second housings, and said fuel transfer means includes a fuel transfer inlet in said first housing communicating with said suction chamber, a fuel transfer outlet in said second housing communicating with said pressure chamber, and conduit means connecting said fuel transfer inlet in communication with said fuel transfer outlet.

14. A pump according to claim 9 wherein said means defining said inlet and outlet chambers comprises and integral housing, and said fuel transfer means comprises an internal passage in said housing extending between said suction and pressure chambers.

* * * * *